US005769151A

United States Patent [19]

Carter, Jr. et al.

[11] Patent Number: 5,769,151

[45] **Date of Patent: *Jun. 23, 1998**

[54] METHODS FOR CONTROLLING THE SUPERHEAT OF THE METAL EXITING THE CIG APPARATUS IN AN ELECTROSLAG REFINING PROCESS

[75] Inventors: William Thomas Carter, Jr., Galway; Mark Gilbert Benz, Burnt Hills; Robert John Zabala, Schenectady; Bruce Alan Knudsen, Amsterdam; Paul Leonard Dupree, Scotia, all of N.Y.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 576,791

[22] Filed: Dec. 21, 1995

[51] Int. Cl.[6] ..... B22D 23/10; C23C 4/12

[52] U.S. Cl. ..... 164/457; 164/493; 164/46; 75/10.24; 266/201

[58] Field of Search ..... 164/470, 471, 164/493–497, 507–509, 513–515, 337, 46, 457; 75/10.1, 10.11, 10.24; 266/201, 202; 222/606, 607; 373/72, 78, 79, 115, 116

[56] References Cited

U.S. PATENT DOCUMENTS 5,160,532 11/1992 Benz et al. ..... 75/10.24
5,310,165 5/1994 Benz et al. ..... 266/201
5,325,906 7/1994 Benz et al. .
5,332,197 7/1994 Benz et al. .
5,348,566 9/1994 Sawyer et al. ..... 164/53
5,366,204 11/1994 Gigliotti, Jr. et al. ..... 266/202
5,366,206 11/1994 Sawyer et al. ..... 266/202
5,472,177 12/1995 Benz et al. .
5,480,097 1/1996 Carter, Jr. et al. .
5,649,992 7/1997 Carter, Jr. et al. ..... 75/10.14
5,649,993 7/1997 Carter, Jr. et al. ..... 75/10.24
5,683,653 11/1997 Benz et al. .

*Primary Examiner*—Kuang Y. Lin
*Attorney, Agent, or Firm*—Ernest G. Cusick; Noreen C. Johnson

[57] ABSTRACT

Methods for controlling the superheat of the stream of molten metal from an electroslag refining apparatus is taught. The methods include the introduction of unrefined metal into an electroslag refining process apparatus in which the unrefined metal is first melted at the upper surface of the refining slag. The molten metal is refined as it passes through the molten slag. The refined metal is collected in a cold hearth apparatus having a skull of refined metal formed on the surface of the cold hearth for protecting the cold hearth from the leaching action of the refined molten metal. A cold finger bottom pour spout or exit orifice is formed at the bottom of the cold hearth to permit dispensing of molten refined metal from the cold hearth. The super heat of the molten metal flowing through the exit orifice of the cold finger apparatus is controlled, preferably utilizing a processor, such as a computer, by coordinating the rate of induction heat supplied to the metal within the cold finger apparatus and the rate of heat removal from the metal within the cold finger apparatus through the cold finger apparatus itself thereby providing metal having a specific superheat exiting the exit orifice.

10 Claims, 5 Drawing Sheets

METHODS FOR CONTROLLING THE SUPERHEAT OF THE METAL EXITING THE CIG APPARATUS IN AN ELECTROSLAG REFINING PROCESS

BACKGROUND OF THE INVENTION

The present invention relates generally to control of the flow of refined metal in an ESR-CIG apparatus. The ESR apparatus is an electroslag refining apparatus and the CIG apparatus is a cold wall induction guide tube apparatus, also referred to herein as a cold wall induction guide mechanism and a cold finger nozzle mechanism. More particularly, the invention relates to methods for controlling the superheat (temperature) of liquid metal flowing to, through and from (as a metal stream) the CIG apparatus. Most particularly, the invention relates to methods for controlling the superheat of the metal provided to an atomization zone during spray forming operations by varying the superheat dynamically in coordination with an atomization manifold oscillation angle.

Such control of the liquid metal superheat is important to numerous applications which can be made using the refining apparatus including atomization processing and relates generally to direct processing of metal passing through an electroslag refining operation. One example of molten metal refining is referred to as electroslag refining, and is illustrated and described in U.S. Pat. No. 5,160,532—Benz et al, assigned to the same assignee as the present invention, the disclosure of which is hereby incorporated by reference.

In an electroslag process, a large ingot of a preferred metal may be effectively refined in a molten state to remove important impurities such as oxides and sulfides which may have been present in the ingot. Simply described, electroslag refining comprises positioning a metal ingot over a pool of molten material in a suitable vessel or furnace where the molten material pool may include a surface layer of solid slag, an adjacent underlayer of molten slag and a lowermost body of refined molten ingot metal. The ingot is connected as an electrode in an electrical circuit including the molten metal pool, a source of electrical power and the ingot. The ingot is brought into contact with the molten slag layer and an electrical current is caused to flow across the ingot/molten slag interface.

This arrangement and process provides electrical resistance heating of the slag and melting of the ingot at the noted interface with the molten ingot metal passing through the molten slag layer as a refining medium to become a part of the body of refined ingot metal. It is the combination of controlled resistance melting and passage of the molten ingot metal through the molten slag layer which refines the ingot metal to remove impurities such as oxides, sulfides, and other undesirable inclusions.

Spray forming is a process using gas atomization to produce a spray of droplets of liquid metal followed by solidification of the spray on a solid body to directly form a billet or billet preform. In metal spray forming, a small stream of refined molten metal from the furnace is directed to pass through a molten metal spray forming atomizer generally comprising a closed peripheral manifold about a central aperture. The manifold may be equipped with gas inlet means and plural gas jet exit means. A gas under pressure is supplied to the manifold to exit through the gas jets in converging streams which impinge the passing metal stream to convert or break up the metal stream into a generally expanding spray of small molten metal droplets. This spray is caused to impinge and deposit on a suitable collector surface to generate a metal billet or other metal object.

An important variable in this process is the gas-to-metal ratio (GMR) which indicates the amount of atomization gas relative to the amount of molten metal which is required to effectively atomize the metal stream to form a spray and to cool the spray in-flight before striking the billet or preform. The spray is scanned across a revolving substrate to build a uniform layer. As it becomes necessary to enlarge the diameter of the preform, it becomes increasingly necessary to control the local temperature of the spray. A relatively hotter spray is desired near the outer diameter of the preform, a relatively cooler spray is desired at the centerline of the preform.

Best results are believed obtained when the molten metal spray pattern from the atomization zone is directed angularly against the collector or preform object rather than perpendicular. An angular impingement provides improved deposition efficiency as well as improved preform metal density and microstructure.

Most previous attempts at varying the gas to metal ratio (GMR) targeted the variation of the gas pressure, thus varying the quantity of gas applied to the atomization process while maintaining the metal stream flow rate as near constant as possible. While this approach has been successful, such an approach is difficult to implement because the gas pressures must be rapidly pulsed.

An alternate approach has recently been suggested in copending patent applications Ser. No. 08/537,963, filed Oct. 2, 1995, Now U.S. Pat. No. 5,649,992 (RD-24,645) assigned to the assignee of the present application, the disclosure of each is hereby incorporated by reference. In these patent applications, the approach disclosed included methods and systems for varying the molten metal flow rate to the atomization zone while maintaining the rate of delivery of the atomizing gas to the molten metal stream constant thereby minimizing the gas pulsation control problem if not eliminating it altogether.

While this approach has the potential for significant cost savings, an alternate method and system for controlling the temperature of the spray impacting the preform would be to vary the temperature of the molten metal melt entering the atomization zone and thus the temperature impacting the preform during spray forming operations.

Thus, it would be desirable to develop methods for varying the superheat of the molten metal provided to the atomization zone while maintaining the rat e of delivery of the atomizing gas to the molten metal stream constant in order to control the temperature of the metal spray delivered to the preform. Such methods could include, among other means, providing varying power to the CIG unit, including the induction power, voltage or current so as to vary, for example, electromagnetically or thermally, the superheat of the metal proximate exit orifice from the CIG, which would in turn dynamically vary the temperature of the metal melt flow therefrom to the atomizer and to further coordinate the controlled, varying metal superheat flow with the scan angle of the atomizer relative to the preform in order to achieve the appropriate spray temperature at various oscillation angles on contact with the preform.

SUMMARY OF THE INVENTION

In one of its broader aspects, the present invention includes methods for controlling the temperature of the melt exiting a cold wall induction guide tube mechanism comprising the steps of: providing a cold wall induction guide tube mechanism including a neck having an exit orifice; operatively forming a skull of melt in the mechanism;

providing a reservoir of melt above the mechanism; providing a stream of melt exiting the exit orifice of the mechanism; and selectively controlling the temperature of the stream of melt exiting the exit orifice wherein the temperature of melt flowing from the exit orifice of the mechanism is selectively increased or decreased thereby controlling the temperature of the melt provided to an atomization zone.

Another aspect of the present invention includes systems for controlling the temperature of the spray from an atomization zone for impacting a preform during the spray forming of the preform comprising: providing a cold wall induction guide tube mechanism including an orifice having a diameter; providing a reservoir of melt operatively connected to the mechanism; providing a stream of melt exiting the orifice; operatively forming a skull of melt in the cold wall induction guide tube mechanism; controlling the temperature of the melt flowing from the orifice; operatively positioning means for forming a preform below the orifice; operatively positioning an atomizer between the orifice and the preform forming means; and atomizing the melt into metal spray.

It is, accordingly, one object of the present invention to provide methods for selectively varying the superheat of the melt proximate the orifice in a cold wall induction guide tube during electroslag refining of metal used in spray forming operations.

Another object is to provide methods for coordinating the temperature of the liquid metal provided to an atomizer during atomization of metal from an electroslag refining apparatus during the spray forming of a preform.

Other objects and advantages of the invention will be apparent from the following description, the accompanying drawings and the appended claims.

DETAILED DESCRIPTION OF THE INVENTION

In carrying out the present invention, an electrode or ingot of metal to be refined is introduced directly into an electroslag refining apparatus for refining the metal and producing a melt of refined metal which is received and retained within a cold hearth apparatus mounted immediately below the electroslag refining apparatus. The molten metal is dispensed from the cold hearth through a cold finger orifice mounted directly below the cold hearth reservoir. The flow of melt from the cold finger apparatus is controlled by one or by a combination of mechanisms including thermal and electro-mechanical means.

If the rate of electroslag refining of metal and accordingly the rate of delivery of refined metal to a cold hearth approximates the rate at which molten metal is drained from the cold hearth through the cold finger orifice, an essentially steady state operation is accomplished in the overall apparatus and the process can operate continuously for an extended period of time and, accordingly, can process a large bulk of unrefined metal to refined metal.

The processing described herein is applicable to a wide range of alloys which can be processed beneficially through the electroslag refining processing. Such alloys include nickel- and cobalt-based superalloys, zirconium and titanium-based alloys, and ferrous-based alloys, among others. The slag used in connection with such metals will vary with the metal being processed and will usually be the slag conventionally used with a particular metal in the conventional electroslag refining thereof.

The several processing techniques may be combined to produce a large body of refined metal because the ingot which can be processed through the combined electroslag refining and cold hearth and cold finger mechanism can be a relatively large supply ingot and can, accordingly, produce a continuous stream of metal exiting from the cold finger orifice over a prolonged period to deliver a large volume of molten metal.

Figure 1:
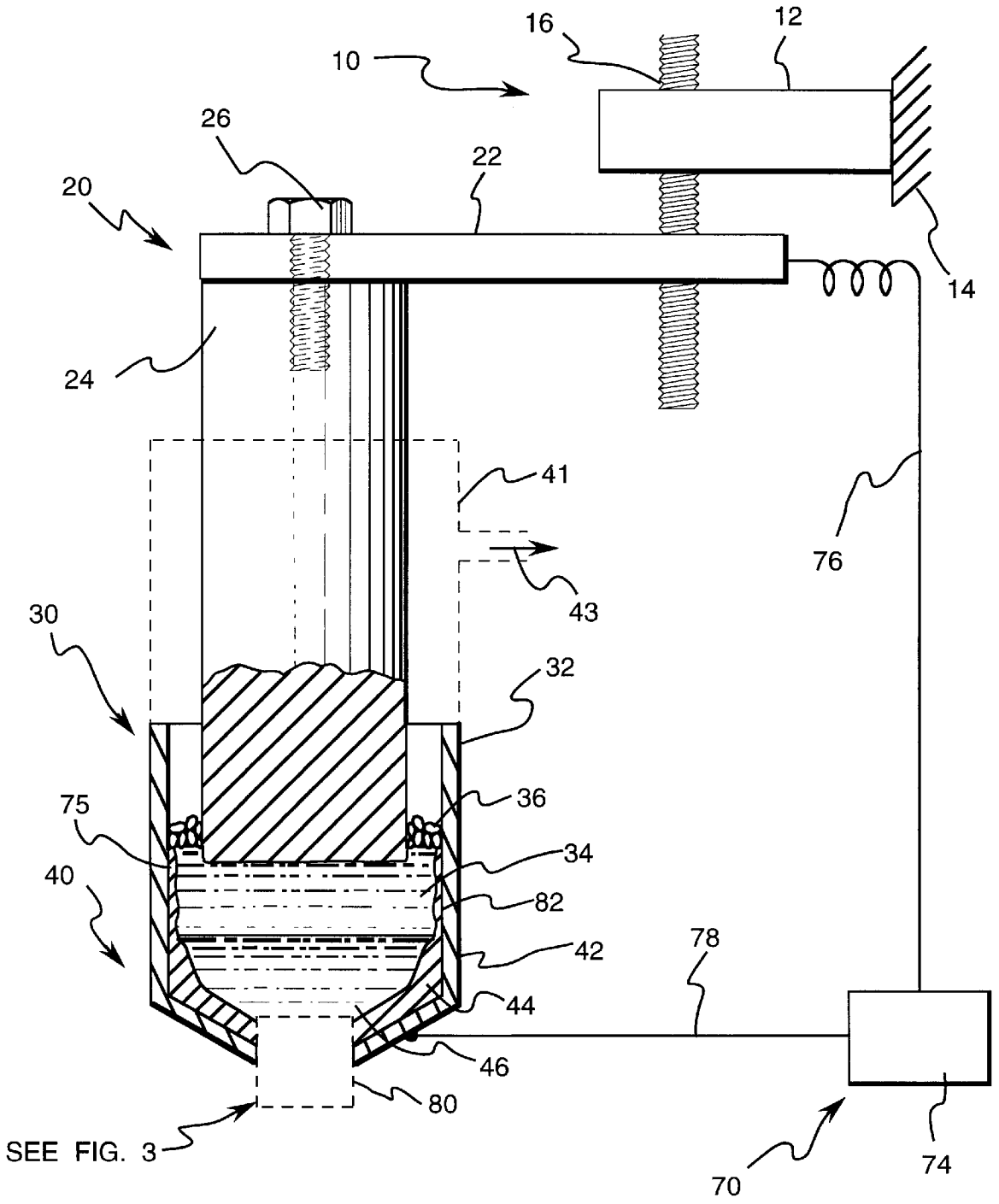
FIG. 1 is a semischematic vertical sectional view of a representative electroslag refining apparatus suitable for use with the present invention.
Figure 2:
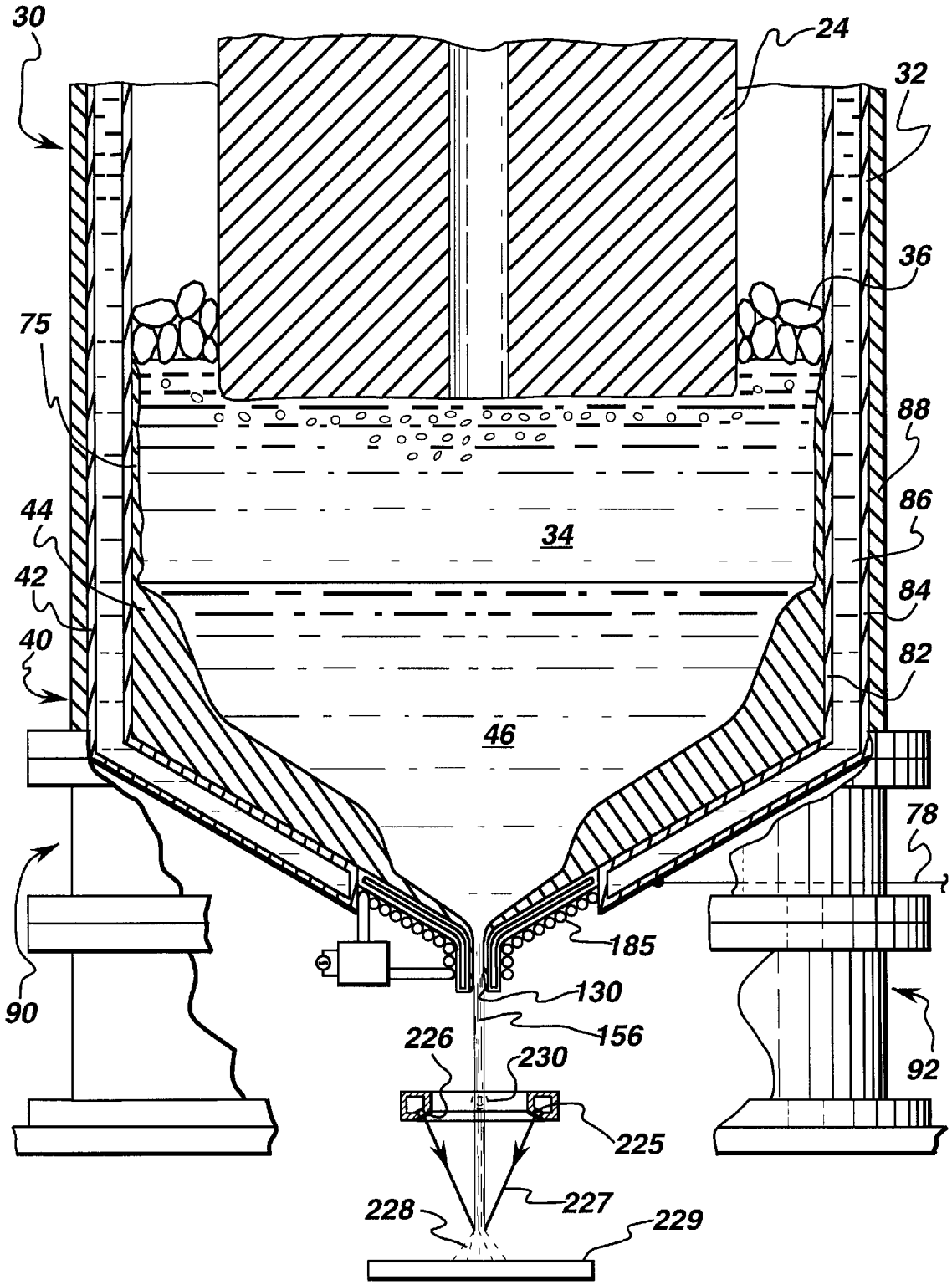
FIG. 2 is a semischematic vertical sectional representative illustration of the apparatus of FIG. 1 but showing structural details of the cold wall induction guide tube and the atomizer.

FIGS. 1 and 2 are semischematic elevational views in part in section of a number of the essential and auxiliary elements of apparatus for carrying out the electroslag refining and atomization aspects of the present invention. A vertical motion control apparatus 10 is shown schematically. It includes a structure 12 mounted to a vertical support 14 for containing a motor or other mechanism adapted to impart rotary motion to a member 16 for example, for illustrative purposes only, a screw or screw mechanism. An ingot support station 20 comprising means 22, such as, for illustrative purposes only, a bar, threadedly engaged at one end to the member 16 and supporting the ingot 24 at the other end by conventional means 26, for example, for illustrative purposes only, a bolt. It being understood that the present illustration is representative in nature only and that in an industrial setting pneumatic, electronic and other well-known methods and apparatus would actually be used, as is known in the art.

An electroslag refining station 30 comprises a cooled, such as, for example, by water, reservoir 32 containing a molten slag 34, an excess of which is illustrated as solid slag granules 36. A skull of slag 75 may form along the inside surfaces of the inner wall 82 of vessel 32 due to the cooling influence of the cooling water flowing against the outside of inner wall 82.

A cold hearth station 40 is mounted immediately below the electroslag refining station 30 and includes a cooled, such as, for example, by water, hearth 42 containing a skull 44 of solidified refined metal and also a body 46 of liquid refined metal. Cooled reservoir 32 may be formed integrally with the cooled hearth 42.

The bottom dispensing structure (shown as an empty dashed box) 80 of the apparatus is provided in the form of a cold finger orifice. The cold hearth dispensing station 80 and the cold finger orifice will be explained more fully below.

Electric refining current is supplied by station 70. The station includes the electric power supply and control mechanism 74. It also includes the conductor 76 carrying current to the bar 22 and, in turn, to ingot 24. Conductor 78 carries current to the metal vessel wall 32 to complete the circuit of the electroslag refining mechanism.

As illustrated by FIG. 2, the station 30 is an electroslag refining station disposed in the upper portion 32 of the vessel and the cold hearth station 40 is disposed in the lower portion 42 of the vessel. The vessel is preferably a double walled vessel having an inner wall 82 and an outer wall 84. Between these two walls, a cooling liquid, such as, for example, water is provided, as is conventional practice with some cold hearth apparatus. The cooling liquid 86 may be flowed to and through the flow channel between the inner wall 82 and outer wall 84 from supply means and through conventional inlet and outlet means which are conventional and which are not illustrated in the figures. The use of cooling liquid 86 to provide cooling to the walls of the cold hearth station 40 is necessary in order to provide cooling at the inner wall 82 and thereby to cause the skull 44 to form on the inner surface of the cold hearth structure.

The cooling liquid 86 is not essential to the operation of the electroslag refining or to the upper portion of the electroslag refining station 30 but such cooling may be provided to ensure that the liquid metal 46 will not make contact with the inner wall 82 of the containment structure because the liquid metal 46 could attack the wall 82 and cause some dissolution therefrom to contaminate the liquid metal of body 46 within the cold hearth station 40. Also, in FIG. 2, a structural outer wall 88 is illustrated. Such an outer wall may be made up of a number of flanged tubular sections 90, 92.

Figure 3:
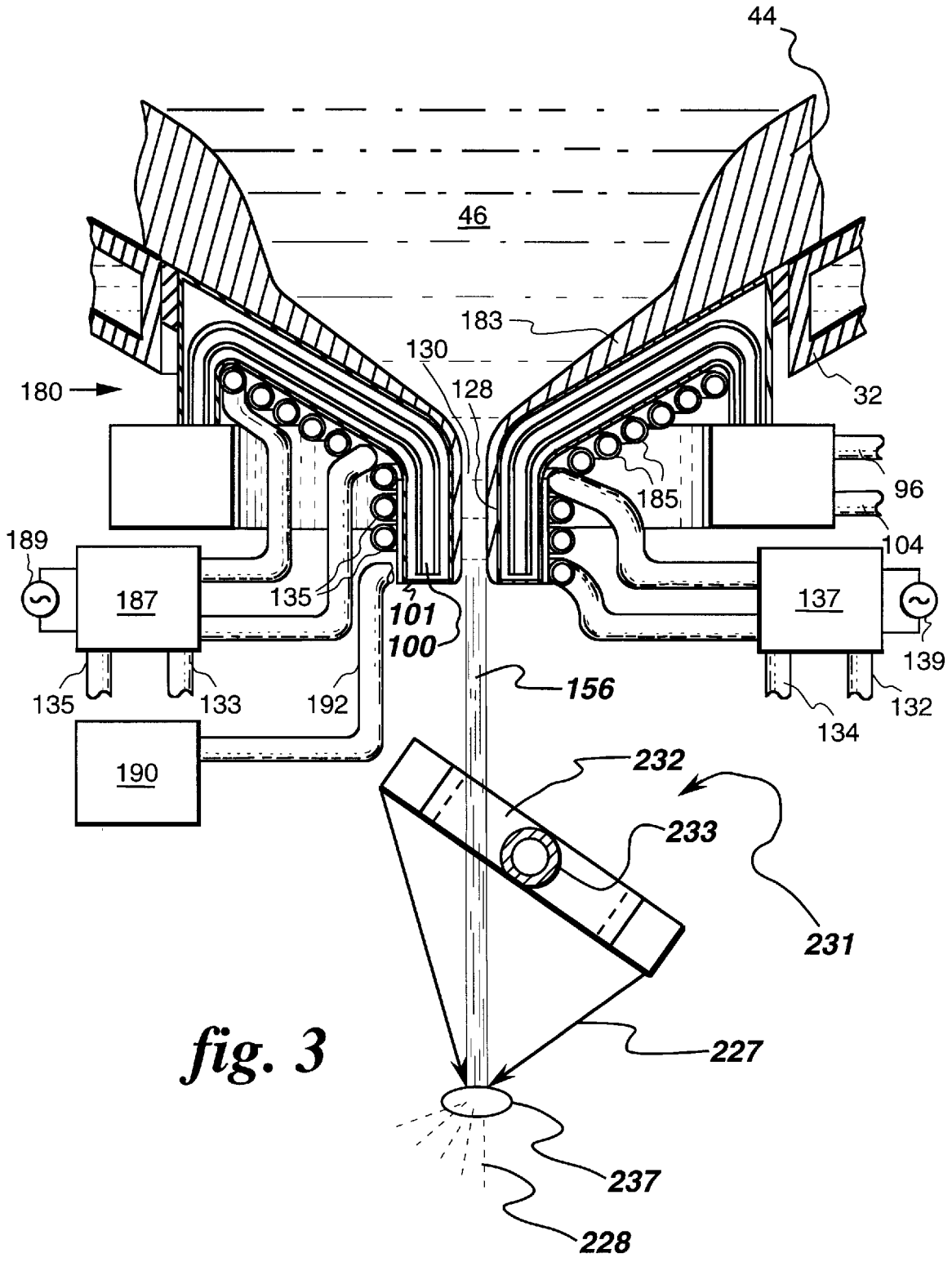
FIG. 3 is a semischematic vertical section in detail of the cold finger nozzle and atomizer of the structures of FIG. 2.
Figure 4:
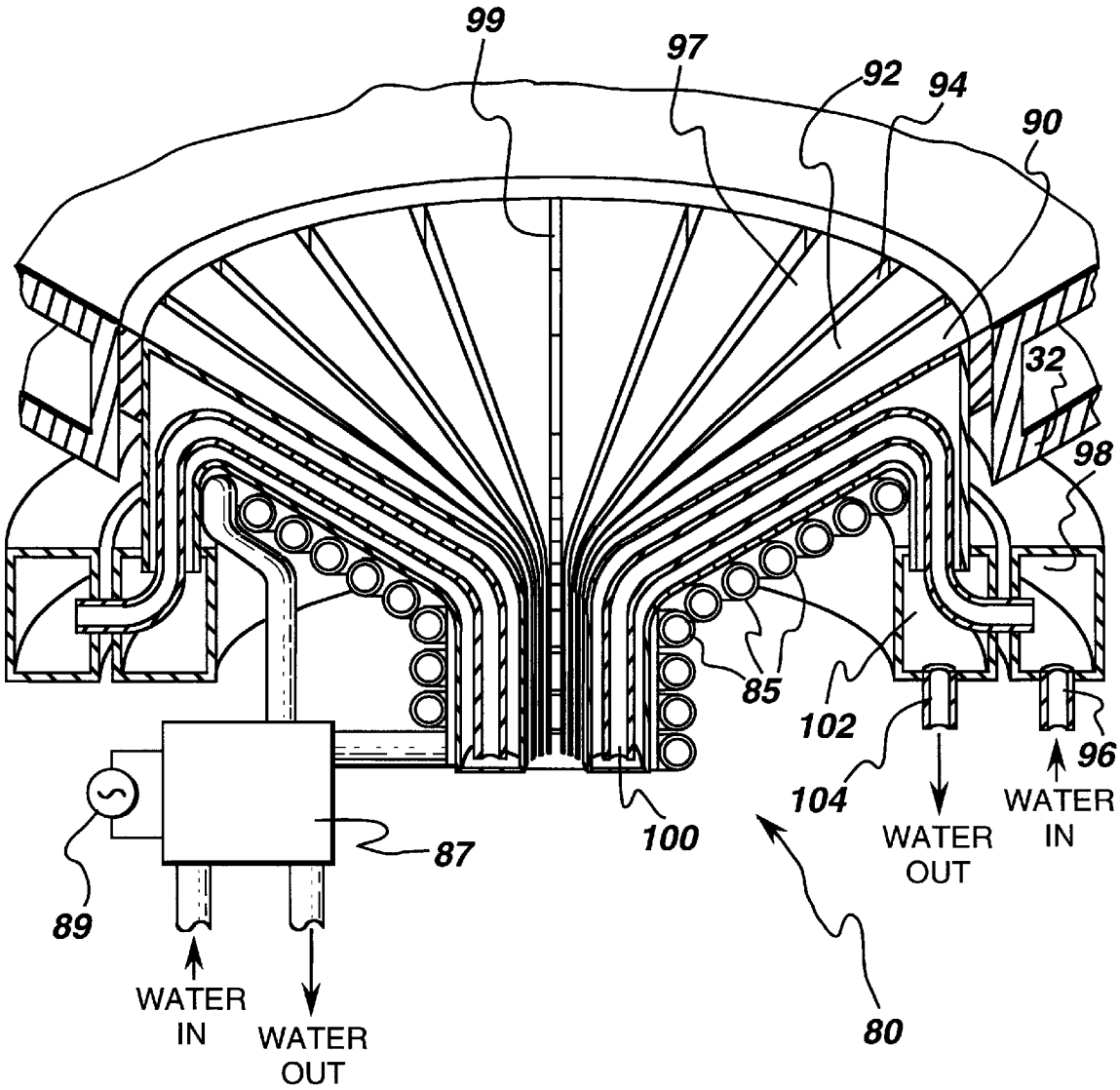
FIG. 4 is a semischematic illustration in part in section of the cold finger nozzle portion of an apparatus similar to that illustrated in FIG. 3 but showing the apparatus free of molten metal.

The cold finger structure is shown in detail in FIG. 3 in its relation to the processing of the metal from the cold hearth structure and the delivery of liquid melt 46 from the cold hearth station 40, as illustrated in FIGS. 1 and 2. FIG. 3 shows the cold finger with the solid metal skull and with the liquid metal reservoir in place. By contrast, FIG. 4 illustrates the cold finger structure without the liquid metal, or solid metal skull in order that more structural details may be provided and clarity of illustration may be achieved. Cold finger structures are not themselves novel structures and have been described in the literature (see, for example, the discussion in U.S. Pat. No. 5,348,566).

One structure useful in the present invention combines a cold hearth with a cold finger orifice so that the cold finger structure effectively forms part, and in the illustration of FIG. 3, the center lower part, of the cold hearth. This combination preserves the advantage of the cold hearth mechanism by permitting the purified alloy to form a skull, by its contact with the cold hearth, and thereby to serve as a container for the molten version of the same purified alloy. In addition, the cold finger orifice structure of station 180 of FIG. 3 is employed to provide a more controllable generally funnel shaped skull 183 and particularly of a smaller thickness on the inside surface of the cold finger structure. As is evident from FIG. 3, the thicker skull 44 in contact with the cold hearth and the thinner skull 183 in contact with the generally funnel shaped cold finger structure are essentially continuous.

One reason why the skull 183 is thinner than 44 is that a controlled amount of heat may be put into the skull 183 and into the generally cone shaped portion of the liquid metal body 46 which is proximate the skull 183 by means of the induction heating coils 185. The induction heating coil 185 is cooled by flow of a cooling liquid, such as, for example, water through the coolant and power supply 187. Induction heating power supplied to the unit 187 from a power source 189 is shown schematically in FIG. 3.

One significant advantage of the cold finger construction of the structure of station 180 is that the heating effect of the induction energy penetrates through the cold finger structure and acts on the body of liquid metal 46 as well as on the skull structure 183 to apply heat thereto. This is one of the features of the cold finger structure and it depends on each of the fingers of the structure being insulated from the adjoining fingers by an air or gas gap or by an insulating material. Hence the term CIG or cold wall induction guide tube mechanism.

This arrangement is clearly illustrated in FIG. 4 where both the skull and the body of molten metal are omitted from the drawing for clarity of illustration. An individual cold finger 97, as shown in FIG. 4, is separated from the adjoining finger 92 by a gap 94, which may be provided with and filled with an insulating material such as a ceramic material or with an insulating gas. The details of the figure are fully disclosed in U.S. Pat. No. 5,348,566, assigned to the assignee of the present application, the disclosure of which is herein incorporated by reference.

Because it is possible to control the amount of heating and cooling passing from the induction coils 185 to and through the cold finger structure of station 180, it is possible to adjust the amount of heating or cooling which is provided through the cold finger structure both to the skull 183 as well as to the generally cone shaped portion of the body 46 of molten metal in contact with the skull 183.

As shown in FIG. 4, the individual fingers such as 90 and 92 of the cold finger structure are provided with a cooling fluid such as water by passing water into the receiving pipe 96 from a source not shown, and around through the manifold 98 to the individual cooling tubes such as 100. Water leaving the end of tube 100 flows back between the outside surface of tube 100 and the inside surface of finger 90 to be collected in manifold 102 and to pass out of the cold finger structure through water outlet tube 104. This arrangement of the individual cold finger water supply tubes such as 100 and the individual separated cold fingers such as 90 is essentially the same for all of the fingers of the structure so that the cooling of the structure as a whole is achieved by passing water in through inlet pipe 96 and out through outlet pipe 104.

The net result of this action is best illustrated in FIG. 3 where a stream 156 of molten metal is shown exiting from the cold finger orifice structure. This flow is maintained when a desirable balance is achieved between the input of cooling water and the input of heating electric power to and through the induction heating coils 185 and 135.

The induction heating coils 85 of FIG. 4 show a single set of coils operating from a single power supply 87 supplied with power from the power source 89. In the structure of FIG. 3, two induction heating coils are employed, the first is placed adjacent the tapered portion of the funnel shaped cold finger device and supplies heat principally to the controllable skull 183. A power source 189 supplies power to power supply 187 and this power supply furnishes the power to the set of coils 185 positioned immediately beneath the tapered portion of the funnel shaped cold finger structure. A second power source 139 furnishes power to power supply 137 and power is supplied from the source 137 to a set of coils 135 which are positioned along the vertical down spout portion of the cold finger apparatus to permit a control of the flow of molten metal from bath 46 through the vertical portion of the cold finger apparatus.

An increase in the amount of induction heating through coil 135 (see FIG. 3) can cause a remelting of the solidified plug of metal in the vertical portion of the cold finger apparatus and a renewal of stream 156 of molten metal through passageway 130. When the stream 156 is stopped or slowed, there is a corresponding growth and thickness of the skull 128 in the vertical portion or neck of the funnel shaped cold finger apparatus.

The regulation of the amount of cooling water flowing to the cold finger apparatus itself as well as the flow of induction heating current through the coils 185 and 135 and particularly the coil 135 regulates the thickness of the thinner skull 128 and the thickness of skull 128 is one of several parameters which regulates the rate of flow of metal from the reservoir 46.

Increases or decreases in the amount of induction heating power through the coils 135, 185 can cause a desired effect, namely an increase or decrease in the superheat of the liquid metal stream 156 exiting the passageway 130. The electromagnetic energy can be used to control the superheat or temperature of the liquid metal in the cold finger apparatus and the stream 156 such that the temperature of the spray 228 impacting the preform 229 is selectively increased or decreased. Thus, the power applied to the coils 135, 185 has a direct influence on the superheat or temperature of metal from the reservoir 46, thus having a direct effect on the temperature of the metal during atomization and subsequently on the spray 228 impacting the preform 229.

In general, during operation of the ESR-CIG system, a steady state is desired in which the rate of metal melted and entering the refining station 30 as a liquid is equal to the rate at which liquid metal is removed as a stream 156 (see FIG. 3) through the cold finger structure and provided to the atomizer 231 for atomization into spray to be formed into a preform. Slight adjustments to increase or decrease the rate of melting of metal are made by adjusting the power delivered to the refining vessel from a power supply such as 74. Also, in order to establish and maintain a steady state of operation of the apparatus, the ingot must be maintained in contact with the upper surface of the body of molten slag 34 and the rate of descent of the ingot into contact with the melt must be adjusted through control means within box 12 to ensure that touching contact of the lower surface of the ingot with the upper surface of the molten slag 34 is maintained.

The deep melt pool 46 within cold hearth station 40 is an advantage in the electroslag refining because a specific flow rate can be established from the reservoir of melt 46 through the flow path 130 (see FIG. 3) from the cold finger apparatus 180.

Generally, control or stoppage of the flow through passageway 130 is accomplished by supplying or withdrawing heat from the melt and essentially increasing or decreasing the size of the skull 128 in the passage way 130 with stoppage occurring with the freezing the metal within the passageway 130. In supplying or withdrawing heat from the melt, it will be appreciated that there are essentially two sources of heat for the metal within passageway 130. One source is heat which is generated in the metal by operation of the coils 135 and 185. The second source is the heat within the melt itself as it flows down from reservoir 46. Although it is possible to stop heating the melt in passageway 130 by stopping the supply of power from power source 137 the metal will remain molten because molten metal is flowing down reservoir 46 to passageway 130 and brings with it the heat of fusion and a degree of superheat already present in the melt.

There are also a number of ways in which heat is removed from melt in passageway 130. A primary source of heat removal and the one which causes the skull 128 to remain in place is the cooling accomplished by flow of water in the cold fingers, such as 100. It is possible to increase or reduce the rate of cooling water flow through the cold fingers in order to increase or decrease the superheat of the melt. Such increase or decrease in the superheat of the melt will increase or decrease the temperature of molten metal delivered to the atomization zone. Thus, one method of controlling the heat of the spray 228 delivered to the surface of the preform 229 is to control the temperature of the melt in passageway 130 that is delivered to the atomization zone 237.

It will be appreciated that the melt superheat regulating means, as discussed above, can be used in combinations, such as, for example, in conjunction with a processor or computer, for controlling the superheat of the melt in passageway 130, subsequently, for controlling the temperature of the metal stream delivered to the atomization zone 237 and for controlling the temperature of the spray 228 delivered to the surface of the preform 229.

When either an increase or a decrease in the superheat of the molten metal within the passageway 130 is desired, the cooling is appropriately increased or reduced, induction heating through coils 135 and/or 185 are appropriately increased or reduced in order to control the superheat or temperature of the melt in passageway 130.

At the lowermost part of vessel 32 a controlled drain orifice 130 communicates with molten metal pool 46. A stream of molten metal 156 is caused to flow from orifice 130 through a spray forming atomizer 231. In one form, atomizer 231 comprises a hollow circular atomizer manifold with a central circular aperture 232 which is concentrically positioned to receive metal stream 156 therethrough. Atomizer 231 also includes a peripheral row of gas jets or orifices 225 in a peripherally continuous tapered or conical edge surface 226. Atomizer 231 is connected to a source (not shown) of a gas under pressure, and the combination of the gas jet orifices 225 and conical surface 226 provides a plurality of gas streams 227 which converge at a downstream apex on the passing metal stream 156. The controlled interaction of the gas jet streams 227 with metal stream 156 causes metal stream 156 to break down and be converted to an expanding spray plume or pattern 228 of small molten metal droplets.

Spray pattern 228 is directed against a collector or preform 229 to provide, for example, a billet of refined ingot metal or other ingot metal objects. Collector 229 may be a fixed or moving surface including a rotating surface such as the surface of a rotating cylinder or mandrel. The efficiency and effectiveness of deposition of molten metal spray 228 on a collector surface to provide a refined metal object is facilitated and improved when the spray pattern 228 may be angularly adjusted with respect to the collector. Angular adjustment also leads to improved density and microstructure of the refined metal product. Continuous and repetitive angular adjustment may also be utilized to provide an oscillating or scanning motion of the atomizer 231.

In order to provide angular adjustment, atomizer 231 may be mounted for angular adjustment rotation about a transverse axis so that the plane of the atomizer is not perpendicular to the metal stream 156. Also, by mounting atomizer 231 for angular adjustment rotation, the defined spray pattern 228 may be more advantageously matched to different surface configurations of collector or preform 229 as compared to a non-adjustable atomizer where the spray pattern is fixedly directed to a limited area of the collector, a condition which may require a complex adjustable mounting of a collector which, for example, may weigh from about 50 lbs. to about 15 tons.

One simple and convenient adjustable mounting for atomizer 231 may comprise a pair of diametrically opposed radially extending stub shafts with atomizer 231 therebetween.

In the past, there have been definite limits to the degree of angular adjustment of atomizer 231. For example, metal stream 156 is a smooth cohesive stream passing concentrically through a circular atomizer 231 with a predetermined atomizer clearance with respect to overall structure of atomizer 231 and its operating characteristics including the use of gas jets from orifices 225 or projecting nozzles.

In a recently issued patent, U.S. Pat. No. 5,366,206, the disclosure of which is hereby incorporated by reference, the spray 228 forming atomizer 231, disclosed therein, had a defined aperture elongated and noncircular such as an elliptical or oval configuration. An elongated, ovate, or elliptical aperture provides an extended range of angular adjustment of an atomizer 231 while maintaining a satisfactory central aperture exposure for the passing metal stream 156 during spray forming.

Figure 5:
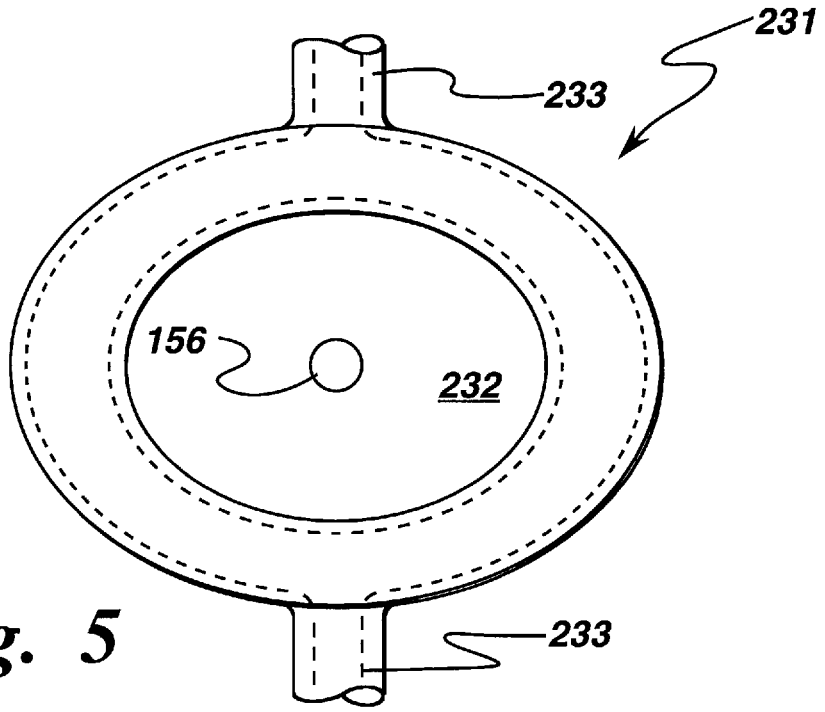
FIG. 5 is a simplified schematic illustration of one form of a non-circular atomizer used in the spray forming process.

Such an elongated non-circular aperture spray forming atomizer is illustrated in FIG. 5. The atomizer 31 comprises a hollow tubular manifold ovately formed to define a central and elongated aperture 232, elliptical, for example and is fitted with and supported by diametrically opposite shafts 233 so that atomizer 231 may be rotated about the common axis of shafts 233, i.e. about a transverse and minor axis of the elliptical aperture 233. One or both shafts 213 may be hollow or tubular to also serve as gas supply conduits for atomizer 231.

The ability to selectively adjust the direction of the molten metal spray pattern 228 provides a greater choice in the position and kind of collector or preform object which is employed. For example, in order to avoid the large bending moments in correspondingly large billets, e.g. approaching 20,000 lbs., it is desirable to orient the billet in a vertical position. Ordinarily, the usual metal melting structure, such as electroslag assembly, FIG. 1, also occupies a vertical position and supplies a vertical melt stream 156. Accordingly, some means is required to provide extended angular adjustability for atomizer 231, FIG. 5, in order to direct spray pattern 228 at selectively advantageous angles to a vertical billet preform. The elongated, oval, or elliptical aperture in the atomizer 231 serves as such means. Very large and cumbersome preforms may be placed in a vertical position where bending moments are minimal and subjected to an advantageously directed spray pattern 228.

Figure 6:
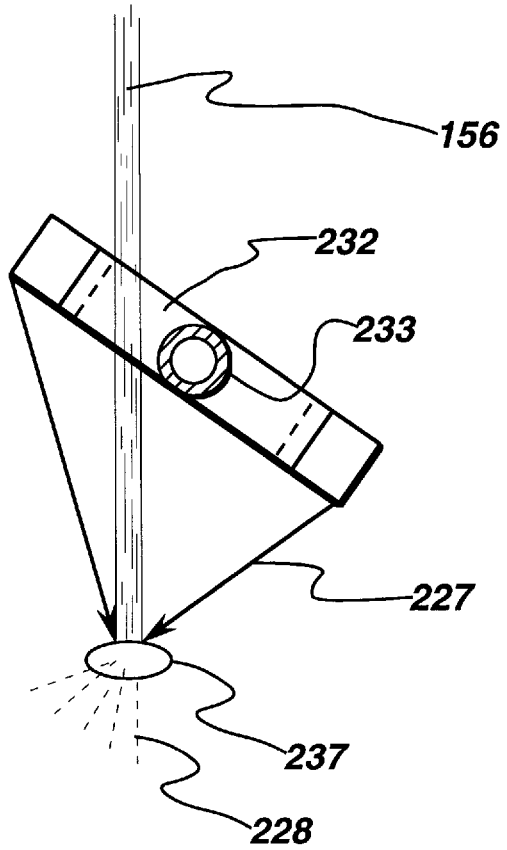
FIG. 6 is a simplified schematic functional illustration of an atomizer impacting a stream of molten metal to produce spray from an atomization zone during the spray forming process.

As shown in FIG. 6, the molten metal stream 156 passes through an atomizer 231 (FIG. 5) for conversion into a molten metal plume or spray pattern 228 (FIG. 2). As illustrated, the atomizer 231 is angularly adjustable about a transverse axis so that it is tilted from its horizontal position, from the viewer's perspective. Maximum adjustment angle is achieved without interference between the atomizer and the passing molten metal stream because of the elongated aperture 232 in atomizer 231 which permits an increased angular adjustment over a circular atomizer. The oval or elliptical aperture 213 provides ample clearance for molten metal stream 156 to provide a gas jet impact or atomization zone 227 for a molten metal spray pattern 228 of increased angular adjustment or deflection.

As illustrated in FIG. 6, a major elongation is not required to obtain the benefits of increasing the angle of adjustment without ring/metal stream interference. Consequently the atomizer used, in the illustration of the present invention, provides maximum advantage where the space available may be at a minimum. The oval or elliptical atomizer 231 (FIG. 5) is supported for angular adjustment rotation about the minor axis of an elliptical aperture 232, i.e. across the illustrated shaft supports 233 to take maximum advantage of the extended range of adjustment provided by the elliptical configuration of aperture 232. Various rotational adjustment means may be attached to one or both shafts 233 for remote electrical or mechanical operation.

The above configuration provided an improved spray forming atomizer for converting a molten metal stream, passing through the atomizer, into a molten metal spray 228. An elongated aperture in the atomizer provided increased angular adjustment of the spray pattern for increased spray 228 deposition effectiveness. Ovate and other elongated aperture configurations may be considered to have major and minor transverse axis dimensions, one of which is longer than the other resulting in what may be defined as providing more clearance, in one direction for the passing metal stream than in the same direction if the atomizer were axially rotated 90°.

Referring again to FIG. 2, it may be the case that the atomized molten metal spray 228 impacts an area on the large preform 229 that is substantially less than the cross-sectional area of the preform 229. In such a case, it is necessary to manipulate either the spray forming atomizer 231, the preform 229, or both, beneath the spray 228 to achieve a uniform build up of atomized and reconsolidate material on the preform 229.

For example, the atomizer 231 may be caused to rock, or "scan" about an axis perpendicular to the axis of the preform 229 while, simultaneously, the preform 229 is caused to rotate beneath the spray 228 and withdraw from the spray 228 at a rate equal to the rate at which material is added to the top of the preform. A steady state operation is accomplished and the process can operate continuously for an extended period of time. In those cases where the preform 229 is substantially larger than the impinging atomized molten metal spray 228, it has been found experimentally that undesirable thermal transients may occur in the resulting metal preform 229. More particularly, the temperature of the preform 229 at the center line may remain at an elevated temperature for a period of time sufficient to allow undesired metallurgical processes to occur such as, for example, grain growth.

In the past, the gas-to-metal ratio (GMR) has been statically adjusted so as to eliminate the undesired thermal transients at the center line of the preform 229. Unfortunately, the resulting cooler spray 228 causes a separate, but equally undesired, thermal transient at the outer diameter which gives rise to other metallurgical defects, typically porosity. Statically adjusting the GMR to satisfy the conflicting requirements of the center line and the outer diameter of the preform 229 has, in the past, limited the maximum diameter preform 229 that can be obtained with the process.

Since preform 229 diameter directly effects the process throughput and thus, process economics, it is desirable to achieve as large a diameter as possible. One method to achieve the higher diameter is to manipulate the GMR with scan angle such that the spray 228 enthalpy is optimized for the location on the preform 229 onto which it will be attached. Typically, this requires a cooler spray 228 at the centerline, and a hotter spray 228 at the outer diameter. As mentioned above, previous attempts at varying the GMR have targeted the variation in gas pressure, thus varying the quantity of gas applied to the atomization process.

An even more recent attempt, and also mentioned above, to vary the GMR was by accomplishing the controlled variation in the metal flow rate, thus, varying the flow rate of the metal supplied to the atomization process in order to vary the GMR. In order to be effective, the metal flow rate must be modulated in coordination with the scan angle of the atomizer 231 to ensure that the appropriate spray 228 conditions exist at the appropriate geometric locations on the preform 229, including the correct GMR.

As mention above, in spray forming, the spray 228 is scanned across a revolving substrate to build a uniform layer. As it becomes necessary to enlarge the diameter of the preform 229, it becomes increasingly necessary to control the local temperature of the spray 228. A hot spray 228 is desired near the outer diameter, a cool spray 228 is desired at the centerline. Thus, controlling the GMR by varying the rate of flow of the molten stream 156 to the atomization zone in coordination with or as a function of scan angle is one method to optimize the subsequent heat transfer conditions of the spray 228 on the preform.

It is known that the temperature of the metal stream is a prime variable in determining the temperature of the substrate on the spray formed preform 229. For example, an about 25° C. change in the superheat of the metal entering the atomization zone 237 can change temperature of the spray at the preform by about 5° C. or more.

In the past, it was not been practical or desirable to vary the temperature of the metal stream at the high frequencies (1–50 Hz) required in spray forming because a large mass of metal must be effected in conventional melting systems other than that described in the present application. However, the cold-walled induction guide does allow such high frequency variation because the energy is applied to a relatively small volume of metal. A ten kilowatt variation in power can result in a change in the superheat of approximately 10° C. which, in turn, can effect the temperature of the substrate on the spray formed preform 229.

Such controlled power variation is useful during spray forming to control the temperature of the spray 228 emanating from the atomization zone and impacting on the preform 229. Specifically, by controlling the superheat or temperature of the stream of metal exiting the cold-walled induction guide orifice 130, along with other variable and controllable parameters, it is possible to ensure a relatively hotter spray 228 near the outer diameter and a relatively cooler spray 228 at and proximate the centerline of the preform 229. By modulating the power output to the cold-walled induction guide in coordination with the oscillation angle of the scanning atomizer 231 such that the temperature/superheat of the flowing metal is appropriately controlled.

It should be understood that, since the operating parameters differ for various geometries, materials and the like, those skilled in the art should be able to design an induction coil and associated power supply or other functionally equivalent means to accomplish the above.

To obtain the desired effect of a varying spray temperature with the preform surface area impacted, it is necessary to coordinate the induction power with the spray scan angle using an appropriate control system, such as, for example, a computer. It may most likely be necessary to determine the temperature of the resulting surface on the preform using an appropriate temperature measuring means, such as, for example, an optical pyrometer adjusted such that a series of temperature readings are sent to the computer. Alternatively, a video imaging system, appropriately calibrated to send the spatial variation in temperature on the preform surface to the computer may be employed. The measured temperature is then used as a parameter for manipulating the induction power provided the coils or adjust the cooling liquid flow rate to selectively increase or decrease the superheat or temperature of the melt in the passageway 130. The superheat of the melt in passageway 130 is then coordinated and controlled by the computer. Such control system provides for spray temperature control so important in the spray forming of preforms, as discussed above. An appropriate control system could include any number of well know systems which a person skilled in the art could modify and implement to effectuate the controlled spray forming of a preform by varying the temperature of the spray according to the appropriate scan angle.

Best spray forming results are believed obtained when the size of the spray pattern impacting the preform/collector is substantially smaller than the size of the overall preform/collector and the spray is scanned across the surface of the preform/collector and when the temperature of the melt is varied as it enters the, atomization zone in order to apply spray having the desired conditions at the various locations on the preform/collector.

While the methods contained herein constitute preferred embodiments of the invention, it is to be understood that the invention is not limited to these precise methods, and that changes may be made therein without departing from the scope of the invention which is defined in the appended claims.

What is claimed is:

1. A method for controlling the temperature of the melt exiting a cold wall induction guide tube mechanism comprising the steps of:

providing a cold wall induction guide tube mechanism including a neck having an exit orifice;

operatively forming a skull of melt in the mechanism;

providing a reservoir of melt above the mechanism;

providing a stream of melt exiting the exit orifice of the mechanism;

selectively controlling the temperature of the stream of melt exiting the exit orifice by selectively heating at least one portion of the cold wall induction guide tube mechanism proximate the exit orifice of the mechanism, wherein the temperature of melt flowing from the exit orifice of the mechanism is selectively increased or decreased thereby controlling the temperature of the melt provided to an atomization zone;

the selectively controlling the temperature of the stream of melt exiting the exit orifice by selectively heating at least one portion of the cold wall induction guide tube mechanism proximate the exit orifice of the mechanism further comprising controllingly power supplied to the at least one portion of the cold wall induction guide tube mechanism to selectively control the temperature of the stream of melt;

forming a spray at the atomization zone;

scanning the spray in a predetermined spray angle; and coordinating the scanning the spray in a predetermined spray angle with the controllingly power, thereby providing the spray with a temperature gradient so spray at an outer portion is at a higher temperature that spray at an inner portion.

2. The method of claim 1 wherein the selectively controlling the temperature of the stream of melt exiting the exit orifice step is accomplished by an induction heater.

3. The method of claim 1 wherein the selectively controlling the temperature of the stream of melt exiting the exit orifice step is accomplished by a cooling liquid.

4. A method for controlling the temperature of the spray from an atomization zone for impacting a preform during the spray forming of the preform comprising:

providing a cold wall induction guide tube mechanism including an orifice having a diameter;

providing a reservoir of melt operatively connected to the mechanism;

providing a stream of melt exiting the orifice;

operatively forming a skull of melt in the cold wall induction guide tube mechanism;

selectively controlling the temperature of the melt flowing from the orifice, wherein the controlling further comprises controlling a temperature of the melt proximate the orifice by controllingly power supplied to the at least one portion of the cold wall induction guide tube mechanism to selectively control the temperature of the stream of melt;

operatively positioning means for forming a preform below the orifice;

operatively positioning an atomizer between the orifice and the preform forming means;

atomizing the melt into metal spray;

scanning the spray in a predetermined spray angle; and coordinating the scanning the spray in a predetermined spray angle with the controllingly power, thereby atomizing the melt into a spray, where the spray further comprises providing the spray with a temperature gradient so spray at an outer portion is at a higher temperature that spray at an inner portion.

5. The method of claim 4 wherein the melt temperature controlling step further comprises:

operatively positioning induction heating means for transferring heat to the melt in the mechanism proximate the mechanism orifice.

6. The method of claim 4 wherein the melt temperature controlling step further comprises:

operatively positioning electromagnetic means for electromagnetically increasing the liquid melt superheat proximate the mechanism orifice.

7. A method for controlling the temperature of the melt exiting a cold wall induction guide tube mechanism comprising the steps of:

providing a reservoir of molten metal;

operatively positioning an exit orifice in the reservoir;

forming a skull of melt in the mechanism;

providing a stream of molten metal exiting the bottom of the mechanism;

selectively heating and cooling the melt such that the temperature of the stream passing through the mechanism is controlled, wherein the selectively heating and cooling the melt further comprises controlling a temperature of the melt proximate the bottom of the mechanism and controllingly power supplied to the at least one portion of the cold wall induction guide tube mechanism to selectively control the temperature of the stream of melt;

operatively positioning a spray forming atomizer for generating a spray pattern of droplets relative the exit orifice;

generating a spray; and scanning the spray in a predetermined spray angle; and coordinating the scanning the spray in a predetermined spray angle with the controllingly power;

directing the atomizer such that the spray pattern of droplets impact a preform, wherein the generating a spray further comprises providing the spray with a temperature gradient by the coordinating and scanning so spray at an outer portion is at a higher temperature that spray at an inner portion.

8. A method for controlling the spray from an atomization zone for impacting a preform during the spray forming of the preform comprising the steps of:

providing an electroslag refining station;

operatively positioning a cold hearth station having molten metal therein relative to the electroslag refining station;

operatively positioning a cold hearth dispensing station for dispensing the molten metal therefrom including a cold finger orifice relative to the cold hearth station;

forming a skull in the cold hearth and the cold finger orifice;

operatively positioning induction coils for providing heat to the molten metal in the vicinity of the cold finger orifice proximate the cold finger orifice;

providing a hydrostatic head of molten metal above the cold finger orifice;

selectively regulating the temperature of the molten metal in the cold finger orifice by selectively heating at least one portion of the cold finger orifice by controllingly power supplied to the at least one portion of the cold orifice to selectively control the temperature of the stream of melt;

operatively positioning means for forming a preform below the orifice;

operatively positioning an atomizer for converting the melt into metal spray between the orifice and the preform forming means;

providing gas at a substantially constant gas pressure to the atomizer; and forming a spray at the atomization zone;

scanning the spray in a predetermined spray angle; and coordinating the scanning the spray in a predetermined spray angle with the controllingly power; the forming the spray further comprising providing the spray with a temperature gradient by the coordinating and the scanning so spray at an outer portion is at a higher temperature that spray at an inner portion.

9. The method of claim 8 wherein the temperature regulating step further comprises:

operatively positioning induction heating means for transferring heat to the melt in the mechanism proximate the mechanism orifice.

10. The method of claim 8 wherein the temperature regulating step further comprises:

operatively positioning electromagnetic means for electromagnetically heating the liquid melt proximate the orifice proximate the mechanism orifice.

* * * * *